US008096264B2

(12) United States Patent
Seitz

(10) Patent No.: US 8,096,264 B2
(45) Date of Patent: Jan. 17, 2012

(54) REPULSION RING

(75) Inventor: David M. Seitz, Riga, MI (US)

(73) Assignee: Illinois Tool Works Inc., Glenview, IL (US)

( * ) Notice: Subject to any disclaimer, the term of this patent is extended or adjusted under 35 U.S.C. 154(b) by 1065 days.

(21) Appl. No.: 11/948,126

(22) Filed: Nov. 30, 2007

(65) Prior Publication Data

US 2009/0140083 A1 Jun. 4, 2009

(51) Int. Cl.
*B05B 5/025* (2006.01)

(52) U.S. Cl. ..... 118/628; 118/625; 118/629; 239/706

(58) Field of Classification Search ..... 118/620–640; 427/457–486; 239/703, 700, 701, 702, 690, 239/706

See application file for complete search history.

(56) References Cited

U.S. PATENT DOCUMENTS

| | | | |
|---|---|---|---|
| 411,410 | A | 9/1889 | Wyman et al. |
| 2,759,763 | A | 8/1956 | Juvinall |
| 2,877,137 | A | 3/1959 | Juvinall et al. |
| 2,890,388 | A | 6/1959 | Croskey et al. |
| 2,955,565 | A | 10/1960 | Schotland |
| 2,960,273 | A | 11/1960 | Croskey et al. |
| 2,996,042 | A | 8/1961 | Juvinall |
| 3,393,662 | A | 7/1968 | Blackwell |
| 3,408,985 | A | 11/1968 | Sedlacsik, Jr. |
| 3,536,514 | A | 10/1970 | LaFave et al. |
| 3,575,344 | A | 4/1971 | Angelico |
| 3,589,607 | A | 6/1971 | Wolf et al. |
| 3,608,823 | A | 9/1971 | Buschor |
| 3,610,528 | A | 10/1971 | Felici |
| 3,684,174 | A | 8/1972 | Bein |
| 3,698,636 | A | 10/1972 | Szasz |
| 3,843,054 | A | 10/1974 | Kendall et al. |
| 3,851,618 | A | 12/1974 | Bentley |
| 3,875,892 | A | 4/1975 | Gregg et al. |
| 3,894,272 | A | 7/1975 | Bentley |
| 3,913,523 | A | 10/1975 | Probst et al. |
| 3,952,951 | A | 4/1976 | Raetz et al. |

(Continued)

FOREIGN PATENT DOCUMENTS

EP 0 509 101 A1 10/1992

(Continued)

OTHER PUBLICATIONS

Aerobell & Aerobell Plus Service Manual, 20 pages, 1992.

(Continued)

*Primary Examiner* — Yewebdar Tadesse
(74) *Attorney, Agent, or Firm* — Barnes & Thornburg LLP

(57) ABSTRACT

A method and apparatus for coating articles with a coating material comprise forming a charged body of coating material, atomizing coating material from the charged body to form charged atomized coating material particles, and repelling the charged coating material particles from an apparatus which forms the charged body of coating material and atomizes the coating material from the charged body to form charged atomized coating material particles. Repelling the charged coating material particles from the apparatus includes providing a repelling electrode, providing a power supply to supply electrical charge of the same polarity as the charged atomized coating material particles, positioning the repelling electrode adjacent a region where the charged atomized coating material particles are formed, and providing on the repelling electrode a feature which increases an electric field gradient adjacent the feature to enhance the repulsive force between the feature and the charged atomized coating material particles.

2 Claims, 5 Drawing Sheets

U.S. PATENT DOCUMENTS

| | | | | |
|---|---|---|---|---|
| 3,964,683 | A | | 6/1976 | Gimple |
| 4,011,991 | A | * | 3/1977 | Masuda ..... 239/708 |
| 4,037,561 | A | | 7/1977 | LaFave et al. |
| 4,066,041 | A | | 1/1978 | Buschor et al. |
| 4,075,677 | A | | 2/1978 | Bentley |
| 4,114,564 | A | | 9/1978 | Probst |
| 4,114,810 | A | | 9/1978 | Masuda |
| 4,135,667 | A | | 1/1979 | Benedek et al. |
| 4,143,819 | A | | 3/1979 | Hastings |
| 4,148,932 | A | * | 4/1979 | Tada et al. ..... 239/3 |
| 4,171,100 | A | | 10/1979 | Benedek et al. |
| 4,187,527 | A | | 2/1980 | Bentley |
| 4,214,708 | A | | 7/1980 | Lacchia |
| 4,215,818 | A | | 8/1980 | Hopkinson |
| 4,216,915 | A | | 8/1980 | Hengartner et al. |
| 4,228,961 | A | | 10/1980 | Itoh |
| 4,323,197 | A | | 4/1982 | Morishita et al. |
| 4,324,812 | A | | 4/1982 | Bentley |
| 4,350,304 | A | | 9/1982 | Sugiyama et al. |
| 4,381,079 | A | | 4/1983 | Allen |
| 4,402,991 | A | | 9/1983 | Meisner |
| 4,422,577 | A | | 12/1983 | Arnold et al. |
| RE31,590 | E | | 5/1984 | Mitsui |
| 4,447,008 | A | | 5/1984 | Allen |
| 4,450,785 | A | | 5/1984 | Meisner |
| 4,481,557 | A | | 11/1984 | Woodruff |
| 4,485,427 | A | | 11/1984 | Woodruff et al. |
| RE31,867 | E | | 4/1985 | Kennon |
| 4,518,119 | A | | 5/1985 | Vetter |
| 4,519,549 | A | * | 5/1985 | Yokoe et al. ..... 239/703 |
| 4,726,521 | A | | 2/1988 | Simm et al. |
| 4,745,520 | A | | 5/1988 | Hughey |
| 4,760,965 | A | | 8/1988 | Schneider |
| 4,771,949 | A | | 9/1988 | Behr et al. |
| 4,779,805 | A | | 10/1988 | Jackson et al. |
| 4,784,331 | A | | 11/1988 | Sharpless et al. |
| 4,785,995 | A | | 11/1988 | Yamane et al. |
| 4,788,933 | A | | 12/1988 | Buschor |
| 4,802,625 | A | | 2/1989 | Buschor |
| 4,811,898 | A | | 3/1989 | Murphy |
| 4,852,810 | A | | 8/1989 | Behr et al. |
| 4,872,616 | A | | 10/1989 | Behr et al. |
| 4,879,137 | A | | 11/1989 | Behr et al. |
| 4,890,190 | A | | 12/1989 | Hemming |
| 4,896,384 | A | | 1/1990 | Dijkhuizen |
| 4,943,005 | A | | 7/1990 | Weinstein |
| 4,955,960 | A | | 9/1990 | Behr et al. |
| 5,011,086 | A | | 4/1991 | Sonnleitner et al. |
| 5,058,812 | A | | 10/1991 | Cox et al. |
| 5,085,373 | A | | 2/1992 | Behr et al. |
| 5,159,544 | A | | 10/1992 | Hughey et al. |
| 5,344,676 | A | * | 9/1994 | Kim et al. ..... 427/468 |
| 5,353,995 | A | | 10/1994 | Chabert |
| 5,413,283 | A | | 5/1995 | Gimple et al. |
| 5,433,387 | A | | 7/1995 | Howe et al. |
| 5,582,347 | A | | 12/1996 | Knobbe et al. |
| 5,622,563 | A | | 4/1997 | Howe et al. |
| 5,633,306 | A | | 5/1997 | Howe et al. |
| 5,662,278 | A | | 9/1997 | Howe et al. |
| 5,720,436 | A | | 2/1998 | Buschor |
| 5,768,800 | A | | 6/1998 | Merritt et al. |
| 5,803,372 | A | | 9/1998 | Weinstein et al. |
| 5,853,126 | A | | 12/1998 | Alexander |
| 5,957,395 | A | | 9/1999 | Howe et al. |
| 5,978,244 | A | | 11/1999 | Hughey |
| 6,012,657 | A | | 1/2000 | Knobbe et al. |
| 6,042,030 | A | | 3/2000 | Howe et al. |
| 6,076,751 | A | | 6/2000 | Austin et al. |
| 6,144,570 | A | | 11/2000 | Hughey |
| 6,230,993 | B1 | | 5/2001 | Austin et al. |
| 6,328,224 | B1 | | 12/2001 | Alexander |
| 6,423,142 | B1 | | 7/2002 | Hughey |
| 6,537,378 | B1 | | 3/2003 | Mauchle |
| 6,562,137 | B2 | | 5/2003 | Hughey |
| 6,676,049 | B2 | | 1/2004 | van der Steur |
| 6,793,150 | B2 | | 9/2004 | Schaupp et al. |
| 6,896,211 | B2 | | 5/2005 | Seitz |
| 6,899,279 | B2 | | 5/2005 | Seitz |
| 7,128,277 | B2 | | 10/2006 | Schaupp |
| 2004/0061007 | A1 | | 4/2004 | Milojevic et al. |
| 2005/0035229 | A1 | | 2/2005 | Zhu et al. |
| 2006/0081729 | A1 | | 4/2006 | Nagai |
| 2008/0178802 | A1 | * | 7/2008 | Sakakibara et al. ..... 118/621 |

FOREIGN PATENT DOCUMENTS

| | | | |
|---|---|---|---|
| FR | 1274814 | | 11/1960 |
| GB | 1209653 | | 10/1970 |
| JP | 58-124560 | | 7/1983 |
| JP | 60-94166 | | 5/1985 |
| JP | 60-151554 | | 10/1985 |
| JP | 62-140660 | | 6/1987 |
| JP | 63-116776 | | 5/1988 |
| JP | 1-315361 | | 12/1989 |
| JP | 3-169361 | | 7/1991 |
| JP | 3-221166 | | 9/1991 |
| JP | 2004-272447 | | 9/2004 |
| JP | 2005-018045 | | 1/2005 |
| WO | WO03031075 | A1 | 4/2003 |
| WO | WO 2006030991 | A1 * | 3/2006 |

OTHER PUBLICATIONS

"Aerobell Powder Applicator, State-of-the-Art Technology for Today's Powder Needs", 2 pages ITW Automotive Division, date unknown.

* cited by examiner

FIG. 1
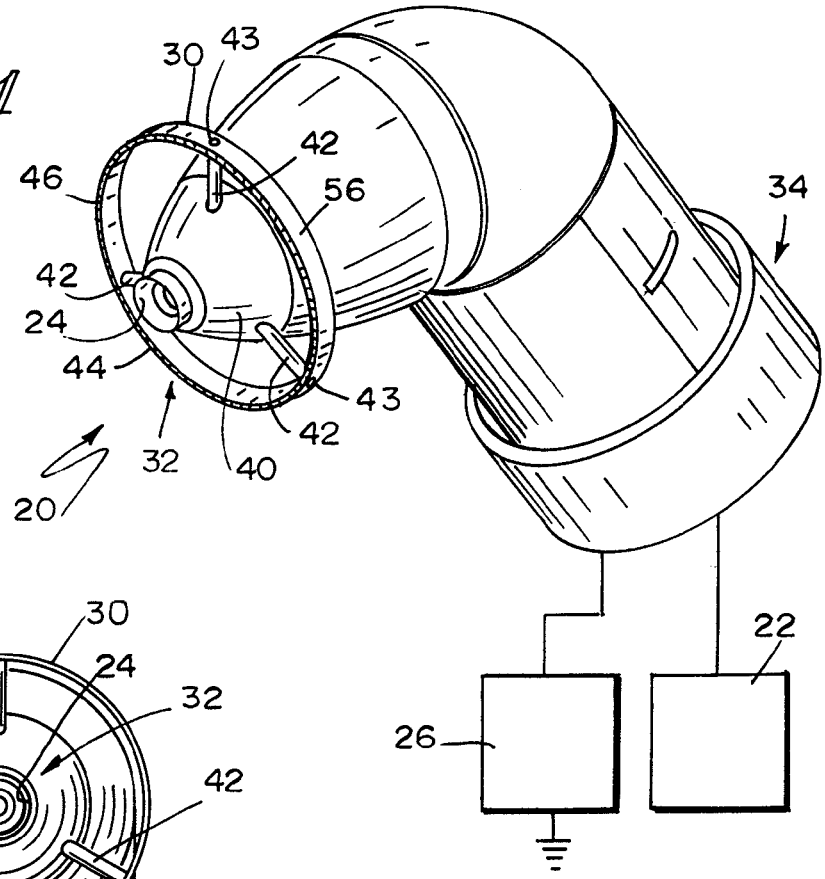
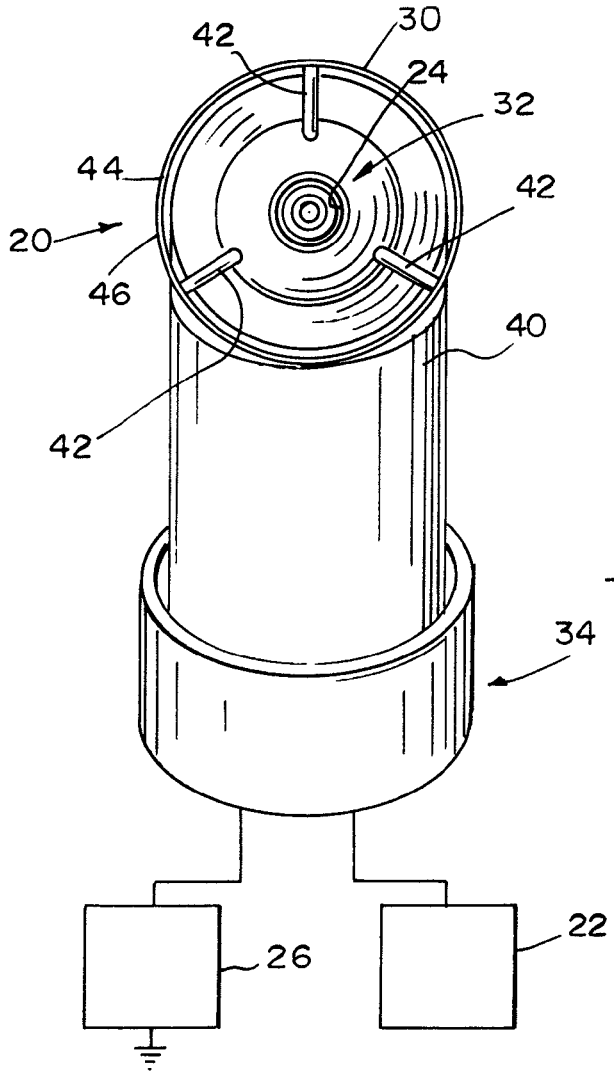
FIG. 2

REPULSION RING

FIELD OF THE INVENTION

This invention relates to coating using electrically charged atomized coating material particles.

BACKGROUND OF THE INVENTION

As used in this application, materials described as "electrically conductive" and "electrically non-insulative" are characterized by conductivities in a broad range electrically more conductive than materials described as "electrically non-conductive" and "electrically insulative." Materials described as "electrically semiconductive" are characterized by conductivities in a broad range of conductivities between electrically conductive and electrically non-conductive. Terms such as "front," "back," "up," "down," and the like, are used only to describe an illustrative embodiment, and are not intended as limiting.

Numerous devices for the coating of articles with atomized, electrostatically charged coating material particles are known. Generally, there are two types of such devices, ones in which the coating material particles are charged by direct contact with surfaces maintained at some non-zero magnitude electrical potential, sometimes called "direct charging," and ones in which the coating material particles are charged after they are atomized, sometimes called "indirect charging." Direct charging is typically used when the material being atomized is electrically non-conductive. The power supply which provides the charge to the direct charging apparatus will not be shorted to ground through the stream of coating material flowing to the atomizer. Indirect charging, on the other hand, typically is used in situations in which the material being atomized is electrically non-insulative, for example, when the material is waterborne, and would otherwise short the power supply which provides the charge to ground absent the presence in the supply line between the coating material source and the atomizer of a so-called "voltage block."

Direct charging devices are illustrated and described in, for example, U.S. Pat. Nos. 3,536,514; 3,575,344; 3,608,823; 3,698,636; 3,843,054; 3,913,523; 3,964,683; 4,037,561; 4,114,564; 4,135,667; 4,216,915; 4,228,961; 4,381,079; 4,447,008; 4,450,785; Re. 31,867; U.S. Pat. Nos. 4,784,331; 4,788,933; 4,802,625; 4,811,898; 4,943,005; 5,353,995; 5,433,387; 5,582,347; 5,622,563; 5,633,306; 5,662,278; 5,720,436; 5,803,372; 5,853,126; 5,957,395; 6,012,657; 6,042,030; 6,076,751; 6,230,993; 6,328,224; 6,676,049; published U.S. patent applications: US 2004/0061007; US 2005/0035229; and WO 03/031075. There are also the devices illustrated and described in U.S. Pat. Nos. 2,759,763; 2,877,137; 2,955,565; 2,996,042; 3,589,607; 3,610,528; 3,684,174; 4,066,041; 4,171,100; 4,214,708; 4,215,818; 4,323,197; 4,350,304; 4,402,991; 4,422,577; Re. 31,590; U.S. Pat. Nos. 4,518,119; 4,726,521; 4,779,805; 4,785,995; 4,879,137; 4,890,190; 5,011,086; 5,058,812 and, 4,896,384; British Patent Specification 1,209,653; Japanese published patent applications: 62-140,660; 1-315,361; 3-169,361; 3-221,166; 60-151,554; 60-94,166; 63-116,776; 2004-272447, PCT/JP2005/018045; and 58-124,560; and, French patent 1,274,814. There are also the devices illustrated and described in "Aerobell™ Powder Applicator ITW Automatic Division;" "Aerobell™ & Aerobell Plus™ Rotary Atomizer, DeVilbiss Ransburg Industrial Liquid Systems;" and, "Wagner PEM-C3 Spare parts list."

Indirect charging devices are illustrated and described in, for example, U.S. Pat. Nos. 5,085,373; 4,955,960; 4,872,616; 4,852,810; 4,771,949; 4,760,965; 4,143,819; 4,114,810; 3,408,985; 3,952,951; 3,393,662; 2,960,273; and, 2,890,388; and published European patent application 0 509 101 A1. Such devices typically provide an electric field through which atomized particles of the electrically non-insulative coating material pass between the atomizing device and the target to be coated by the atomized particles.

DISCLOSURE OF THE INVENTION

According to an aspect of the invention, a method of coating articles with a coating material comprises forming a charged body of coating material, atomizing coating material from the charged body to form charged atomized coating material particles, and repelling the charged coating material particles from an apparatus which forms the charged body of coating material and atomizes the coating material from the charged body to form charged atomized coating material particles. Repelling the charged coating material particles from the apparatus includes providing a repelling electrode, providing a power supply to supply electrical charge of the same polarity as the charged atomized coating material particles, positioning the repelling electrode adjacent a region where the charged atomized coating material particles are formed, and providing on the repelling electrode a feature which increases an electric field gradient adjacent the feature to enhance the repulsive force between the feature and the charged atomized coating material particles.

Illustratively according to this aspect of the invention, providing a repelling electrode and positioning the repelling electrode adjacent a region where the charged atomized coating material particles are formed together comprise providing a repelling ring and orienting the repelling ring adjacent and surrounding the region where the charged atomized coating material particles are formed.

Illustratively according to this aspect of the invention, providing a repelling ring includes providing on the repelling ring an edge spaced closer to the region where the charged atomized coating material particles are formed and providing on the repelling ring a portion more remote than the edge from the region where the charged atomized coating material particles are formed.

Illustratively according to this aspect of the invention, providing on the repelling electrode a feature which increases an electric field gradient adjacent the feature and providing on the repelling ring an edge together comprise providing the feature on the edge.

Illustratively according to this aspect of the invention, providing on the repelling electrode a feature which increases an electric field gradient adjacent the feature comprises providing on the electrode a plurality of teeth extending around the perimeter of the ring.

According to another aspect of the invention, apparatus for coating articles with a coating material comprises a source of the coating material, at least one source of electrical charge, and an atomizer adapted for atomizing the coating material. The coating material source is coupled to the atomizer to supply coating material thereto. The apparatus further includes at least one source of electrical charge coupled to the atomizer to charge the coating material as it is atomized, a repelling electrode adapted to be positioned adjacent the atomizer, and at least one source of electrical charge coupled to the repelling electrode to supply electrical charge thereto. The repelling electrode includes a feature which increases an electric field gradient adjacent the feature to enhance the repulsive force between the feature and the charged atomized coating material particles.

Illustratively according to this aspect of the invention, the repelling electrode comprises a repelling ring adjacent and surrounding a region of the atomizer from which charged atomized coating material particles are dispensed.

Illustratively according to this aspect of the invention, the repelling ring includes an edge spaced closer to the region of the atomizer from which charged atomized coating material particles are dispensed and a portion more remote than the edge from the region of the atomizer from which charged atomized coating material particles are dispensed.

Illustratively according to this aspect of the invention, the feature is provided on the edge.

Illustratively according to this aspect of the invention, the feature comprises a plurality of teeth extending around the perimeter of the ring.

BRIEF DESCRIPTION OF THE DRAWINGS

The invention may best be understood by referring to the following detailed description and accompanying drawings which illustrate the invention. In the drawings:

FIG. 1 illustrates a partly diagrammatic perspective view of a system incorporating the invention;

FIG. 2 illustrates a partly diagrammatic front elevational view of the system illustrated in FIG. 1;

DETAILED DESCRIPTIONS OF ILLUSTRATIVE EMBODIMENTS

An atomizer 20 of the general type described in, for example, one of U.S. Pat. Nos. 6,899,279; 6,896,211; 6,793,150; and references cited in these patents, is employed to atomize a liquid or powder coating material supplied from a supply 22, all according to known principles. If the coating material is a pulverulent material (hereinafter sometimes a powder coating material or simply powder), the source 22 may be, for example, a fluidized bed of the general type illustrated and described in U.S. Pat. No. 5,768,800.

Figure 3:
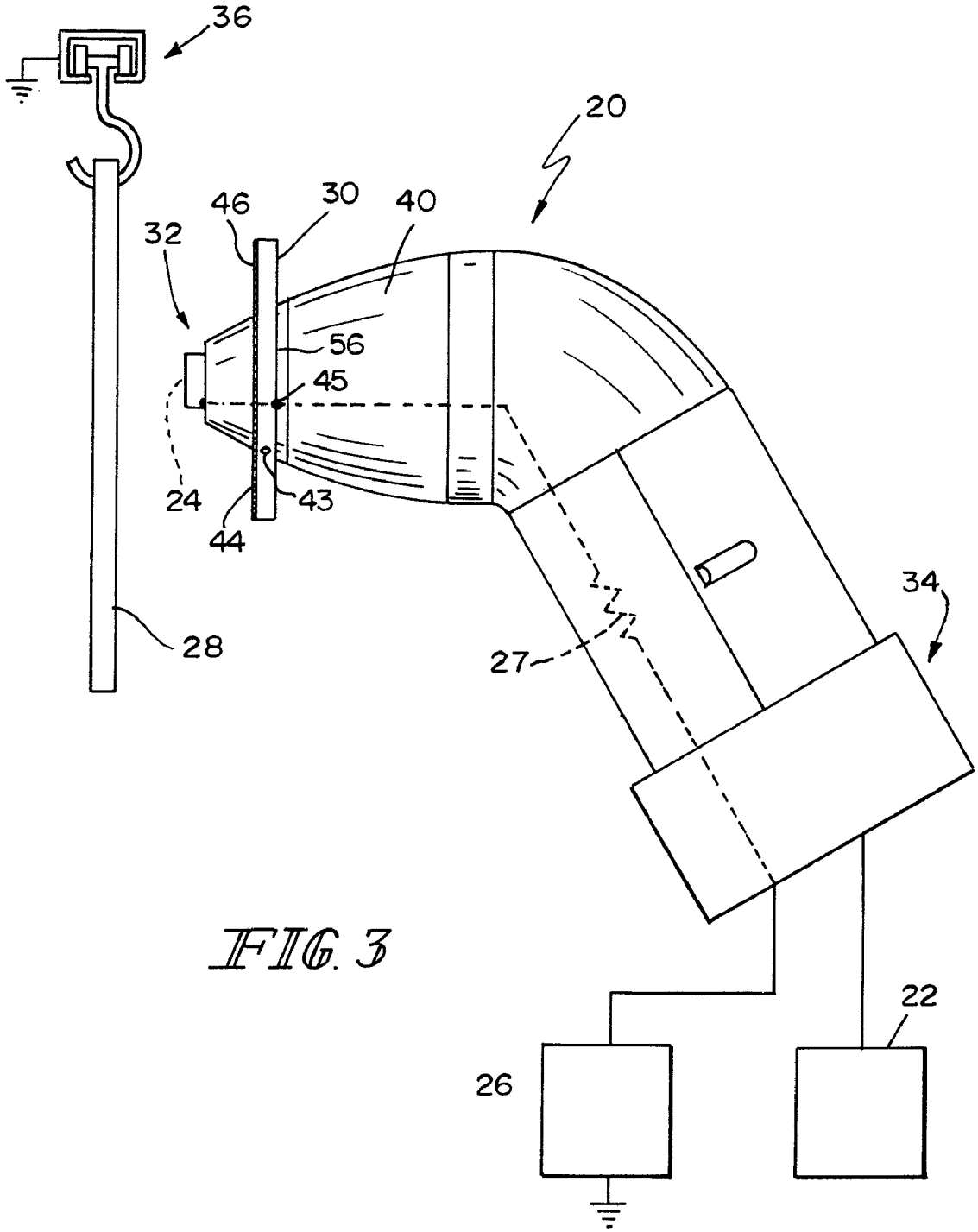
FIG. 3 illustrates a partly diagrammatic side elevational view of the system illustrated in FIGS. 1-2.
Figure 4:
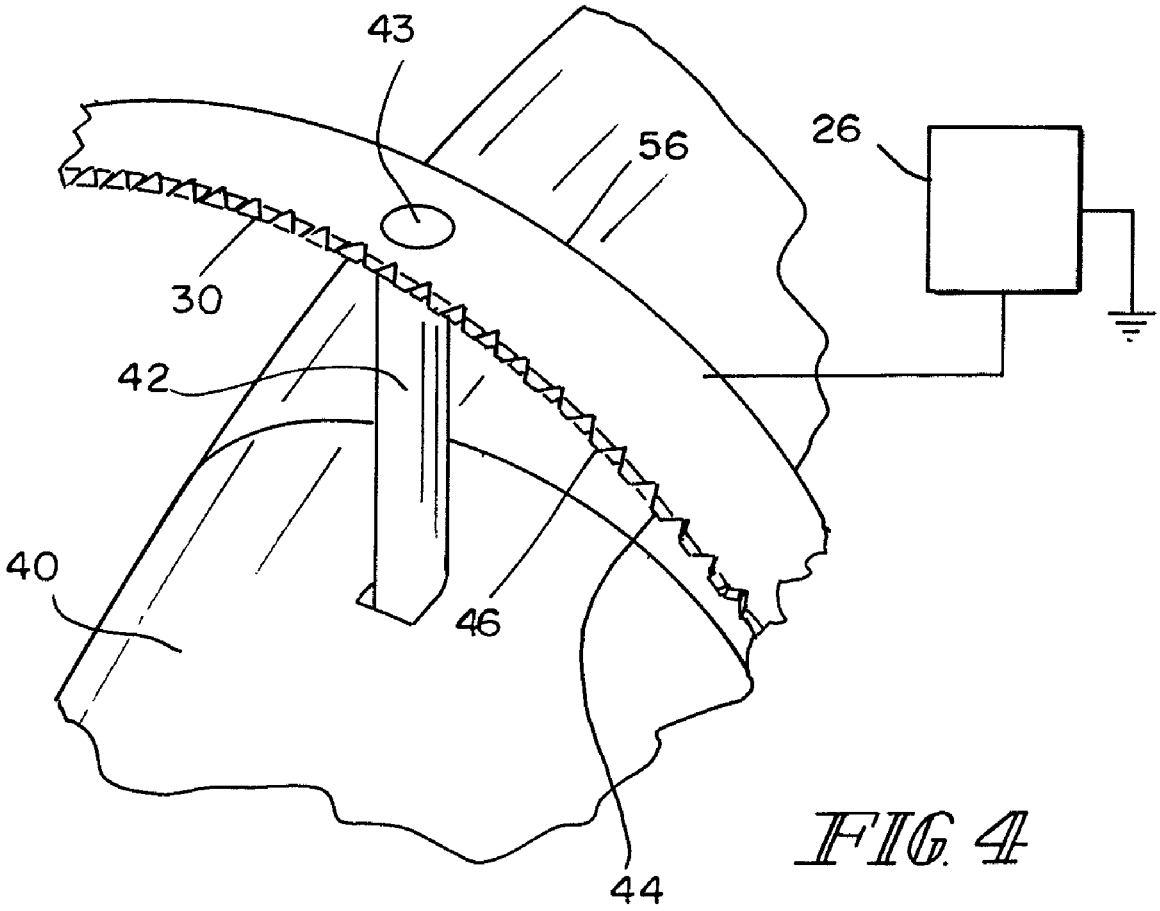
FIG. 4 illustrates a partly diagrammatic enlarged perspective view of a detail of the system illustrated in FIGS. 1-3.
Figure 5:
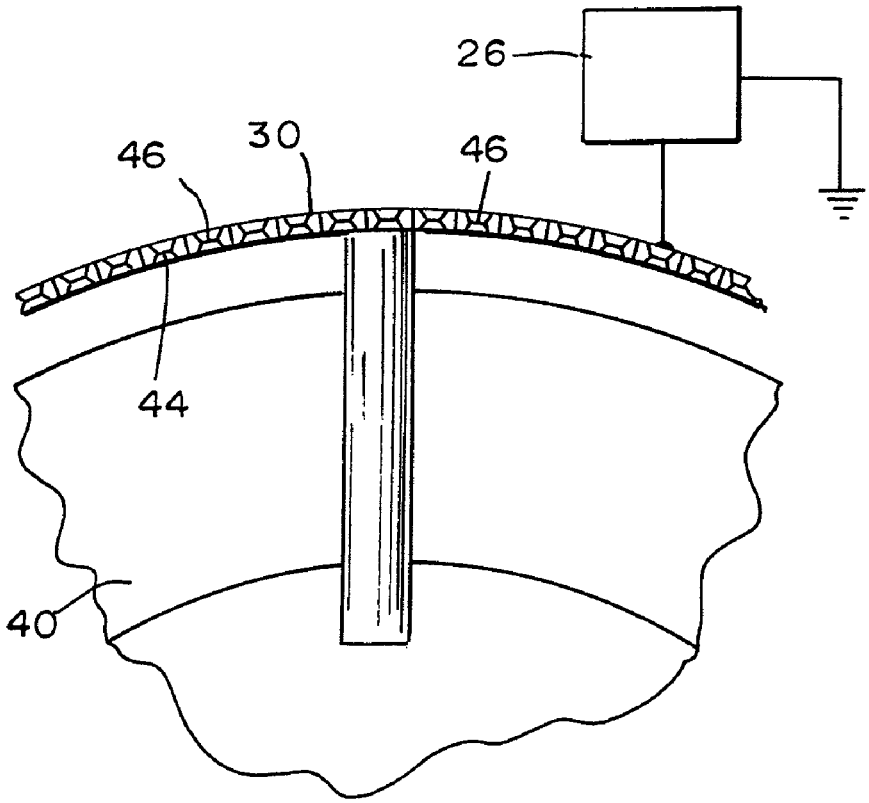
FIG. 5 illustrates a partly diagrammatic enlarged front elevational view of the detail illustrated in FIG. 4.
Figure 6:
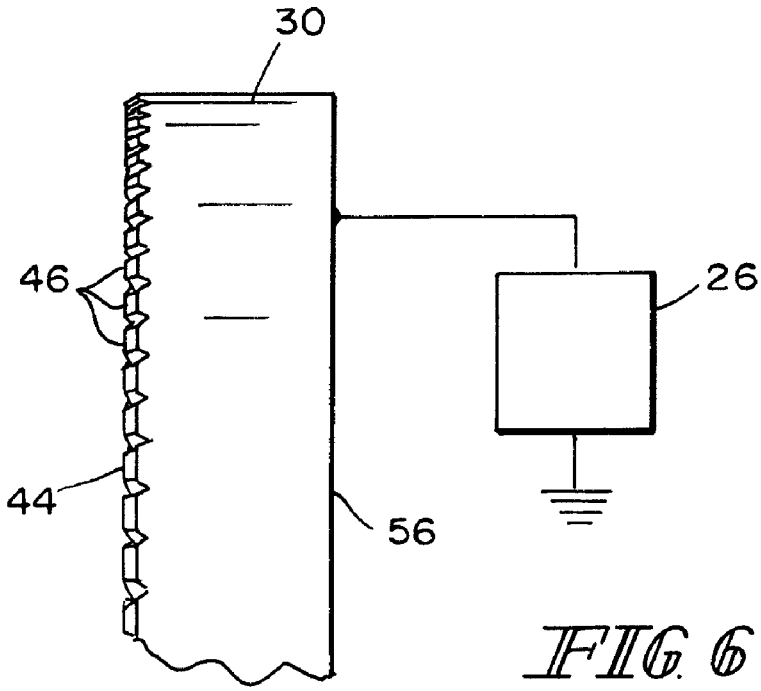
FIG. 6 illustrates a partly diagrammatic enlarged side elevational view of the detail illustrated in FIGS. 4-5; and, FIG. 7 illustrates a fragmentary partly diagrammatic side elevational view showing some equipotential lines associated with the device illustrated in FIGS. 1-6 when the device is maintained at the same potential as the atomizer and the article to be coated is maintained at ground.

The illustrated atomizer 20 is a direct charging atomizer. Consequently, the coating material comes in contact with a surface 24 which is held at a high magnitude, typically negative, electrostatic potential in order to charge the particles of coating material before or as they are atomized and dispensed. A suitable power supply 26 for coupling to the atomizer 20 to achieve this charging may be one of the type illustrated in, for example, U.S. Pat. Nos. 6,562,137; 6,537,378; 6,423,142; 6,144,570; 5,978,244; 5,159,544; 4,745,520; 4,485,427; 4,481,557; 4,324,812; 4,187,527; 4,075,677; 3,894,272; 3,875,892; and, 3,851,618. Power supply 26 is typically coupled to atomizer 20 through a damping resistor 27 (FIG. 3) of suitable resistance, in accordance with known principles. The thus directly charged particles are atomized and are attracted toward nearby oppositely charged or uncharged, grounded objects, all in accordance with known principles.

While every effort is made to ensure that grounded articles 28 (FIGS. 3 and 7), hereinafter sometimes targets, to be coated are the closest things to the charged particles as they are atomized, inevitably, some of the atomized charged particles are attracted toward other objects and are deposited on those objects, soiling them. This overspray typically is cleaned off at times when it is convenient to do so, or if it builds up to an intolerable level.

In accordance with the invention, a repelling ring 30 is mounted on the atomizer 20 between the region 32 of the atomizer 20 from which the atomized coating material particles are discharged and a support 34, such as, for example, a mounting of the atomizer 20 to the arm of a robot manipulator (see, for example, U.S. Pat. No. 5,413,283) which manipulates the atomizer 20 to coat the targets 28 as the targets 28 are conveyed past the atomizer 20 on a conveyor 36.

The illustrative repelling ring 30 is formed from a flat strip of electrically non-insulative material, for example, stainless steel or an electrically non-insulative (for example, carbon filled) resin or polymer ring, and is mounted to, for example, an electrically non-conductive housing or shroud 40 of the atomizer 20, illustratively by three circumferentially equally spaced insulative posts 42 to which the ring 30 is attached by, for example, threaded fasteners 43. In an exemplary embodiment, ring 30 is constructed from stainless steel and is coupled through a stainless steel path 45 (FIG. 3) to the atomizer 20-to-resistor 27 connection.

A front edge 44, that is, the edge of the ring 30 closest to the region 32 of the atomizer 20 from which the charged atomized coating material particles are dispensed, illustratively is formed with features 46 which permit the formation of high electric field gradients between the front edge 44 and the targets 28 being conveyed past the atomizer 20. Illustrative features 46 include bicycle sprocket tooth-shaped or saw-tooth-shaped features, and the like. The high field gradients established between features 46 and the targets 28 mask regions of the shroud 40, the robot arm 34 to which the atomizer 20 is mounted, and other grounded objects and surfaces behind the front edge 44, that is, in the direction opposite region 32, from the charged atomized particles.

Figure 7:
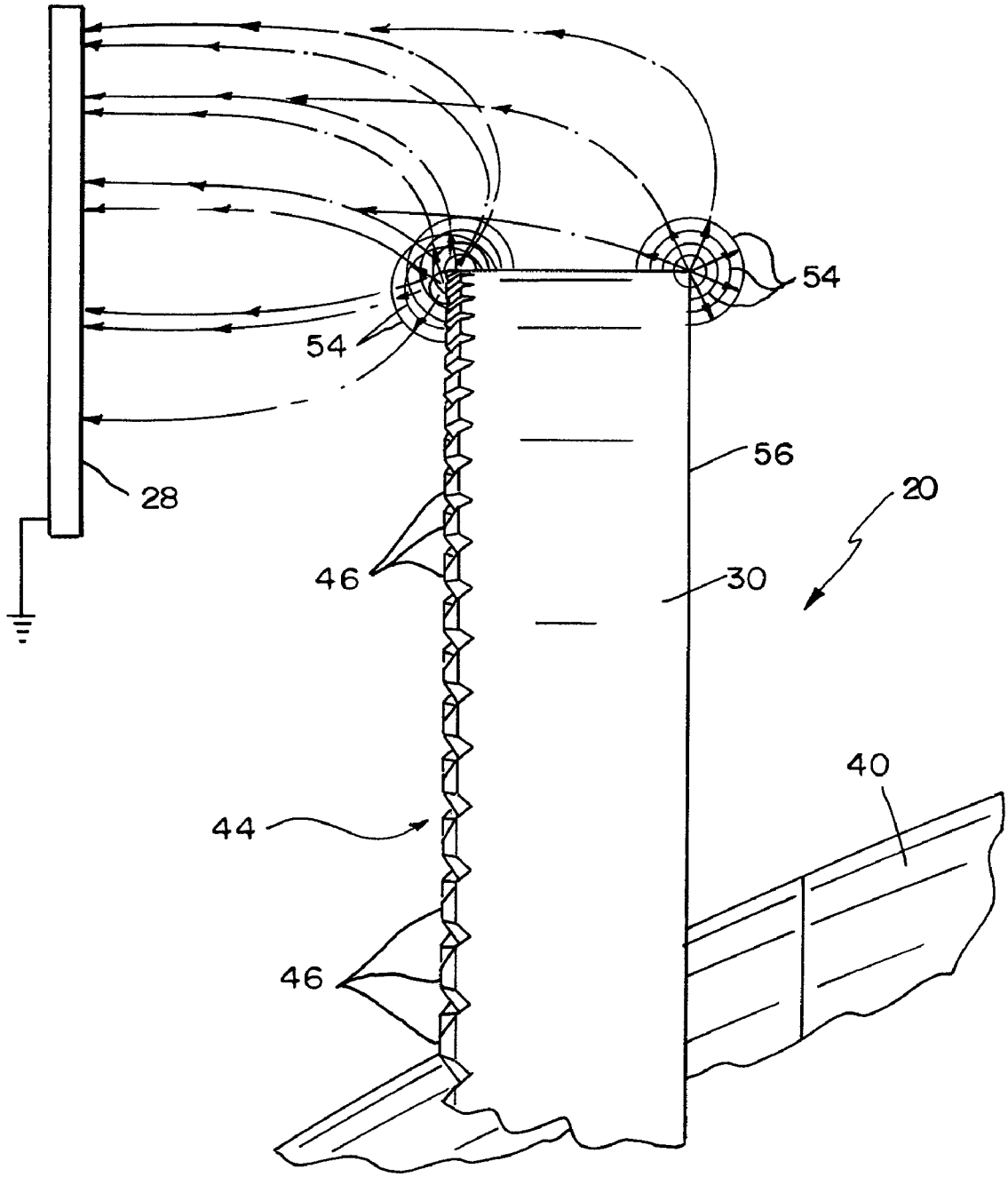

FIG. 7 illustrates some equipotential lines 54 close to the features 46 on edge 44 and close to the opposite, rearward edge 56 of ring 30 when the ring 30 is charged to the same potential as the atomizer 20. The axially forward edge 44 has multiple, somewhat triangular prism-shaped, pyramid-shaped, bicycle sprocket tooth-shaped, or the like, edge-containing features 46 that provide high magnitude potential fields in a generally forward (toward the target 28) radial and axial direction to assist in pattern shaping and atomizer cleanliness. All of the edges of features 46 are oriented in a generally forward direction.

Many prior art rings have points or edges pointing radially and axially, but it is believed that these prior art rings do not provide as concentrated an electric field in one direction as does the present invention. The forward concentration of the edges of the features 46 on edge 44 tends to concentrate the field in the direction towards the target 28. It is believed that this permits the coating material particles more time in the field, enhancing the high magnitude electrical charge on the particles and enhancing their attraction toward the target 28. Prior art devices that use radial sharp points and solid round wires are believed to be less effective because paint particles are not subjected to as high a field gradient, and tend to lose more of their forward velocity, resulting in a greater tendency for them to be deposited on nearby surfaces other than the target 28.

The disclosures of all of the cited references are hereby incorporated herein by reference. This listing is not intended to be a representation that a complete search of all relevant art has been made, or that no more pertinent art than that listed exists, or that the listed art is material to patentability. Nor should any such representation be inferred.

What is claimed is:

1. Apparatus for coating articles with a coating material comprising a source of the coating material, at least one source of electrical charge, an atomizer adapted for atomizing the coating material, the coating material source coupled to the atomizer to supply coating material thereto, at least one source of electrical charge coupled to the atomizer to charge the coating material as it is atomized, a repelling electrode positioned adjacent the atomizer, at least one source of electrical charge coupled to the repelling electrode to supply electrical charge thereto, the repelling electrode including a feature which increases an electric field gradient adjacent the feature to enhance the repulsive force between the feature and the charged atomized coating material particles, the repelling electrode comprises a repelling ring adjacent and surrounding a region of the atomizer from which charged atomized coating material particles are dispensed, the repelling ring formed from a flat strip of electrically non-insulative material having first and second edges, the first edge spaced closer to the region of the atomizer from which charged atomized coating material particles are dispensed than the second edge, the feature comprising a plurality of bicycle sprocket tooth-shaped or sawtooth-shaped teeth extending around the perimeter of the repelling ring and formed in the first edge.

2. Apparatus for coating articles with a coating material comprising a source of the coating material, at least one source of electrical charge, an atomizer adapted for atomizing the coating material, the coating material source coupled to the atomizer to supply coating material thereto, at least one source of electrical charge coupled to the atomizer to charge the coating material as it is atomized, a repelling electrode positioned adjacent the atomizer, at least one source of electrical charge coupled to the repelling electrode to supply electrical charge thereto, the repelling electrode including a feature which increases an electric field gradient adjacent the feature to enhance the repulsive force between the feature and the charged atomized coating material particles, the repelling electrode comprises a repelling ring adjacent and surrounding a region of the atomizer from which charged atomized coating material particles are dispensed, the repelling ring includes an edge spaced closer to the region of the atomizer from which charged atomized coating material particles are dispensed and a portion spaced more remote from the region of the atomizer from which charged atomized coating material particles are dispensed, the feature being provided on the edge, the feature comprising a plurality of bicycle sprocket tooth-shaped or sawtooth-shaped teeth extending around the perimeter of the repelling ring.

* * * * *